US011578845B2

(12) United States Patent
Avila

(10) Patent No.: US 11,578,845 B2
(45) Date of Patent: Feb. 14, 2023

(54) LED ILLUMINATION SYSTEM FOR THE INTERIOR OF A REFRIGERATED PRODUCT DISPLAY CABINET

(71) Applicant: VISION ENGINEERING, Mansfield, TX (US)

(72) Inventor: Henry Avila, Mansfield, TX (US)

(73) Assignee: VISION ENGINEERING, Mansfield, TX (US)

( * ) Notice: Subject to any disclaimer, the term of this patent is extended or adjusted under 35 U.S.C. 154(b) by 0 days.

(21) Appl. No.: 16/950,257

(22) Filed: Nov. 17, 2020

(65) Prior Publication Data

US 2021/0148528 A1 May 20, 2021

Related U.S. Application Data

(60) Provisional application No. 62/937,490, filed on Nov. 19, 2019.

(51) Int. Cl.

| | |
|---|---|
| ***F21S 4/28*** | (2016.01) |
| ***F21V 23/04*** | (2006.01) |
| ***F21V 7/04*** | (2006.01) |
| *F21Y 107/90* | (2016.01) |

(Continued)

(52) U.S. Cl.

CPC ..... *F21S 4/28* (2016.01); *F21V 7/048* (2013.01); *F21V 23/0471* (2013.01); *F21Y 2103/10* (2016.08); *F21Y 2107/90* (2016.08); *F21Y 2115/10* (2016.08)

(58) Field of Classification Search

CPC .... F21V 23/0471; F21V 7/048; F21V 7/0025; F21V 7/005; F21V 7/0083; F21Y 2107/90; F21Y 2115/10; F21Y 2103/10; F21S 4/28; F21W 2131/305

See application file for complete search history.

(56) References Cited

U.S. PATENT DOCUMENTS

| | | | | |
|---|---|---|---|---|
| 7,985,004 | B1 | 7/2011 | Schach et al. | |
| 8,882,302 | B2 | 11/2014 | Avila | |
| 10,222,048 | B2 * | 3/2019 | Dingemans | F21V 23/0457 |

(Continued)

OTHER PUBLICATIONS

International Searching Authority, International Search Report and Written Opinion for corresponding International Application No. PCT/US2020/060868, dated Feb. 8, 2020, 8 pages.

*Primary Examiner* — Kevin Quarterman
(74) *Attorney, Agent, or Firm* — David R. Heckadon; Gordon Rees Scully Mansukhani LLP

(57) ABSTRACT

A lighting system for providing uniform bright lighting of products within in a glass door refrigerated cabinet. The lighting system has a frame member with an angled wing extending therefrom that wraps around a side edge of a light-transmitting optical shield, and a LED lighting strip positioned between the frame member and the optical shield. The LED lighting strip has a plurality of spaced-apart LED lights mounted therealong with a coined reflective facet optic mounted around each LED light. The angled wing(s) reflects light emitted laterally outwards from the at least one LED lighting strip such that the light can be re-directed to evenly illuminate products in a refrigerated cabinet. The angled wing(s) also protects a user's fingers from cracking the plastic optical shield which can become brittle in the cool or cold temperatures of the refrigerated cabinet.

20 Claims, 10 Drawing Sheets

(51) Int. Cl.
*F21Y 115/10* (2016.01)
*F21Y 103/10* (2016.01)

(56) References Cited

U.S. PATENT DOCUMENTS

| | | | | |
|---|---|---|---|---|
| 11,125,400 | B2 * | 9/2021 | Miles | F21V 31/005 |
| 2012/0014107 | A1 | 1/2012 | Avila | |
| 2013/0265750 | A1 | 10/2013 | Pickard et al. | |
| 2014/0355272 | A1 | 12/2014 | Chou | |

* cited by examiner

LED ILLUMINATION SYSTEM FOR THE INTERIOR OF A REFRIGERATED PRODUCT DISPLAY CABINET

RELATED APPLICATION

The present application claims priority to U.S. Provisional Patent Application 62/937,490, of same title, filed Nov. 19, 2019, the entire disclosure of which is incorporated herein by reference in its entirety for all purposes.

TECHNICAL FIELD

The present system relates to LED lighting systems in general and to LED lighting systems for use in illuminating the interiors of refrigerated cabinets in particular.

BACKGROUND OF THE INVENTION

Refrigerated product display cabinets having front glass doors have been in use in grocery and convenience stores for many years. Unfortunately, properly illuminating the interiors of these cabinets has been somewhat challenging for various reasons. For example, it is desired to provide a bright and even illumination across the products without casting shadows on the products. Another problem is that the lighting systems that have been used in the past also needed to be protected such that the customer's hands (or the product that the customer is holding onto with their hands) does not simply bump into and damage the lighting system. This problem was especially difficult in the case of long fluorescent tube cabinet lighting which can be quite fragile and easily broken. Fluorescent tube lighting therefore has its drawbacks.

Incandescent lights have also been installed in refrigerated cabinets. Unfortunately, these smaller "spot"-type light sources tend to provide very uneven lighting and often cast shadows. Shadows are a particular problem when the customer's hands are moving around in the cabinet looking over the products. As a result, it can become somewhat difficult to easily read product labels. As such, incandescent lights are also not desirable.

What is instead desired is a system that first provides sufficiently bright lighting on the products such that it is easy to read the product labels. Moreover, it is most desirable to be able to read product labels without even having to open the glass front door of the cabinet. In addition, it is also important to still provide a sufficiently diffuse lighting across the products such that both glare on the product labels is minimized, and shadows are avoided (to make reading the product labels easier). Reliance on a light coming from only a few "spot"-type lights (i.e.: illumination by sending light from only a few directions) is specifically to be avoided.

Yet another problem with lights in refrigerated cabinets in particular is that the operating temperatures in which the lighting system runs are quite cool or even cold. As such, plastic lighting system components (such as plastic shields hanging over the lights) tend to become brittle at these colder temperatures and can chip off and injure a customer's hands (or injure the hands of a worker initially loading the products into the refrigerated cabinet).

Therefore, what is instead desired is a lighting system which operates well at cooler temperatures, yet provides excellent lighting and is inherently safe (i.e.: it provides protection for the hands of the customer or worker stocking the cabinet).

As will be shown, the present system advantageously meets the above requirements, providing excellent lighting at low temperatures while also protecting customer's hands.

SUMMARY OF THE INVENTION

In preferred aspects, the present system provides illumination ideally suited for use in a refrigerated cabinet. As will be explained herein, the present system provides bright illumination (making it easy to read the labels of products within the cabinet), yet does not produce glare on the face of these products or their labels. In addition, with the present system, a customer staring through the front glass doors of the cabinet does not see "spots" (i.e.: individual point light sources). Rather, a bright, aesthetically pleasing diffuse lighting is provided.

In preferred aspects, the present system comprises: a frame member having a base with at least one angled wing extending away from the base; a light-transmitting optical shield mounted onto the frame member; with at least one LED lighting strip positioned between the frame member and the optical shield, wherein the LED lighting strip has a plurality of spaced-apart LED lights mounted therealong with a coined reflective facet optic mounted around each LED light; and wherein the at least one angled wing extends outwardly beyond a side edge of the light-transmitting optical shield to reflect light emitted from the at least one LED lighting strip.

A first advantage of the present angled wing design is that it extends outwardly from the side of the lighting system to reflect light that has been emitted laterally (i.e.: outwardly to the side) by the LEDs, thereby redirecting this light onto the fronts of products in the cabinet (which are typically positioned somewhat recessed a few inches behind the glass front doors of the cabinet).

A second advantage of the present angled wing design is that the angled wing itself wraps around a side edge of the plastic optical shield that covers the LEDs. As such, no edges of the plastic optical shield are directly exposed to the user's hands. By protecting the user's hands from the plastic optical shield with this metal wing, the risk of the plastic optical shield becoming brittle and breaking (in the cold temperatures of the refrigerated cabinet) is completely avoided.

In preferred aspects, the light-transmitting optical shield has a side portion and a top portion, and the angled wing reflects light emitted in the lateral direction through the side portion. The angled wing preferably has a height equal to the height of the side portion of the optical shield (so that the angled wing fully covers the side of the illumination system). In preferred aspects, the angled wing extends away from the base of the frame member at an angle between 20 and 60 degrees, and most preferably about 30 degrees.

Another advantage of the present lighting system is its ease of manufacture and assembly. Conveniently, the angled wing and the frame member itself are preferably formed (e.g.: extruded, bent or molded) from the same block of material, and the optical shield is simply slipped into the frame member such that the angled wing wraps around the side edge of the optical shield.

In optional preferred aspects, the lighting system further comprises a microwave proximity sensor mounted onto the frame member. Preferably, this microwave proximity sensor is mounted spaced apart from the base of the frame member. For example, the microwave proximity sensor is mounted recessed a few inches from the front glass doors of the cabinet. As such, the microwave sensor's signal has a clear path of transmission through the glass door of the cabinet. In operation, the microwave sensor detects the presence of a customer in the area around the cabinet and the cabinet lighting can then be turned on (or simply increased in intensity) when a customer walks towards the refrigerated cabinet. Ideally, the microwave sensor may operate with such a high sensitivity such that the cabinet illumination may be turned on while the customer is still an aisle away in the store. As such, customers would not even see the cabinet lighting being turned on or turned up as they approach the cabinet.

In one preferred embodiment, the present lighting system can be positioned at the center of a refrigerated cabinet by being mounted on a center beam between two opening glass doors. In this first embodiment, the light that is emitted outwardly from the sides of the lighting system is reflected by a pair of angled wings onto the products in the cabinet that are positioned on either side of the center beam. Basically, this first embodiment provides illumination on both sides of the assembly. In this first embodiment, the pair of angled wings extending from opposite sides of the frame member base, and the at least one LED lighting strip is a pair of lighting strips positioned back-to-back perpendicular to the base of the frame member. A further advantage of this first embodiment is that there is no intervening support wall required between the pair of back-to-back LED strips. This both makes manufacturing easier and makes assembly faster and more economic.

In a second preferred embodiment, the illumination system is mounted at a side of the refrigerated cabinet. This embodiment provides illumination on one side of the assembly. This second embodiment has a side wall with the LED strip on one side and one angled wing on the other side. In this second embodiment, a side wall extends perpendicular to the base of the frame, and there is only one angled wing that extends from an opposite side of the base. The LED lighting strip is a single LED lighting strip positioned against or adjacent to this side wall. Advantageously, this second embodiment can simply be mounted either right-side-up or upside-down (thereby working either as a left-handed or right-handed version, providing illumination from the front left side, or from the front right side of the cabinet, as desired).

In preferred aspects, both the first and second embodiments of the lighting system are used together. Preferably, one of the first "two-wing" embodiment and two of the second "one-wing" embodiments are used together to illumination the refrigerated cabinet, as follows. Specifically, the two wing first embodiment is positioned at the center of the cabinet to illuminate in both the left and right directions. One of the second embodiments is positioned at the left side of the cabinet to provide illumination to the right. The other of the second embodiments is positioned (upside down) at the right side of the cabinet to provide illumination to the left. Together, these three lighting systems illuminate each of the products in the cabinet from both the left and right directions (thereby minimizing the effects of shadows). As a result, the products sitting on both sides of the cabinet receive diffuse front lighting coming from two different sides.

It is to be understood, however, that other lighting arrangements are also contemplated (all keeping within the scope of the present invention). For example, the present lighting systems can all instead be mounted horizontally so as to provide interior cabinet lighting from above and below. In addition, different combinations of the first and second embodiments can be used. For example, in the case of a large refrigerated cabinet with many glass doors positioned side-by-side, a plurality of two wing (i.e.: first embodiment) devices can be positioned on the successive vertical beams separating these glass doors. As a result, illumination is provided both to the left and right from a location on each of these vertical beams. Other lighting placements and combinations are also contemplated, all keeping within the scope of the present invention.

In both the first and second embodiments of the present system, the light-transmitting optical shield preferably extends continuously across the top and one or both sides of the lighting system. The coined reflective facet optic mounted around each LED light operates to minimize glare and provide focus. Specifically, light from each LED is either reflected by the facet optic and thus passes out of the top of the light-transmitting optical shield, or the light passes laterally straight out of the side of the light-transmitting optical shield and is then reflected by the angled wing that extends from the frame member. (It is to be understood that due to scattering and internal reflection, some light will inevitably be reflected off the facet optic and still pass laterally out of the side of the light-transmitting optical shield). Advantageously, however, the present internal system components do not create any external shadows with the optical guard permitting light emission over a 90 or near 180 degree angle. Broadly speaking, the present system comprises the inventive combination of LEDs with coined reflective facet optics together with angled wing reflective diverters.

To the customer viewing the products in the cabinet, there will be no glare or shadows on the face of the products, and no bright "dots" from the LEDs will be seen. Instead, a bright yet diffuse light will be projected onto the fronts of the products in the cabinet.

Assembly of both embodiments of the present system is fast and easy with the side edges of the optical shield simply being slid into one or two angled wings, and the LED lighting strip (together with its coined reflective facet optics) being slid into position between the base and the optical shield. As will also be explained herein, the assembly of the LED lighting strip (and associated coined reflective facet optics) can be carried out quickly and easily.

DETAILED DESCRIPTION OF THE DRAWINGS

The present illumination system will be described herein in an exemplary use inside a refrigerated cabinet (for example, the refrigerated cabinets having glass front doors that are typically found in grocery and convenience stores for placing milk, dairy products, sodas, frozen dinners, etc. into). It is to be understood, however, that the present lighting system could be used in other contexts and arrangements and that the claims below are not limited solely to uses in refrigerated cabinets.

In preferred aspects, the present lighting system includes a "two-wing" embodiment that can be mounted vertically onto a central beam at the front of a refrigerated cabinet to cast light towards both the left and right sides of the cabinet. The present lighting system also includes a "one-wing" embodiment that can be mounted vertically onto a side beam at the of the refrigerated cabinet to cast light either only to the left side or to the right side of the beam. Merely by mounting this "one-wing" embodiment right-side-up or upside-down, the illumination can be directed either to the left side or to the right side.

It is also to be understood, however, that the various embodiments of the present system can alternatively be mounted horizontally (for example at the top and bottom of the cabinet), thereby providing illumination upwardly or downwardly.

Figure 1:
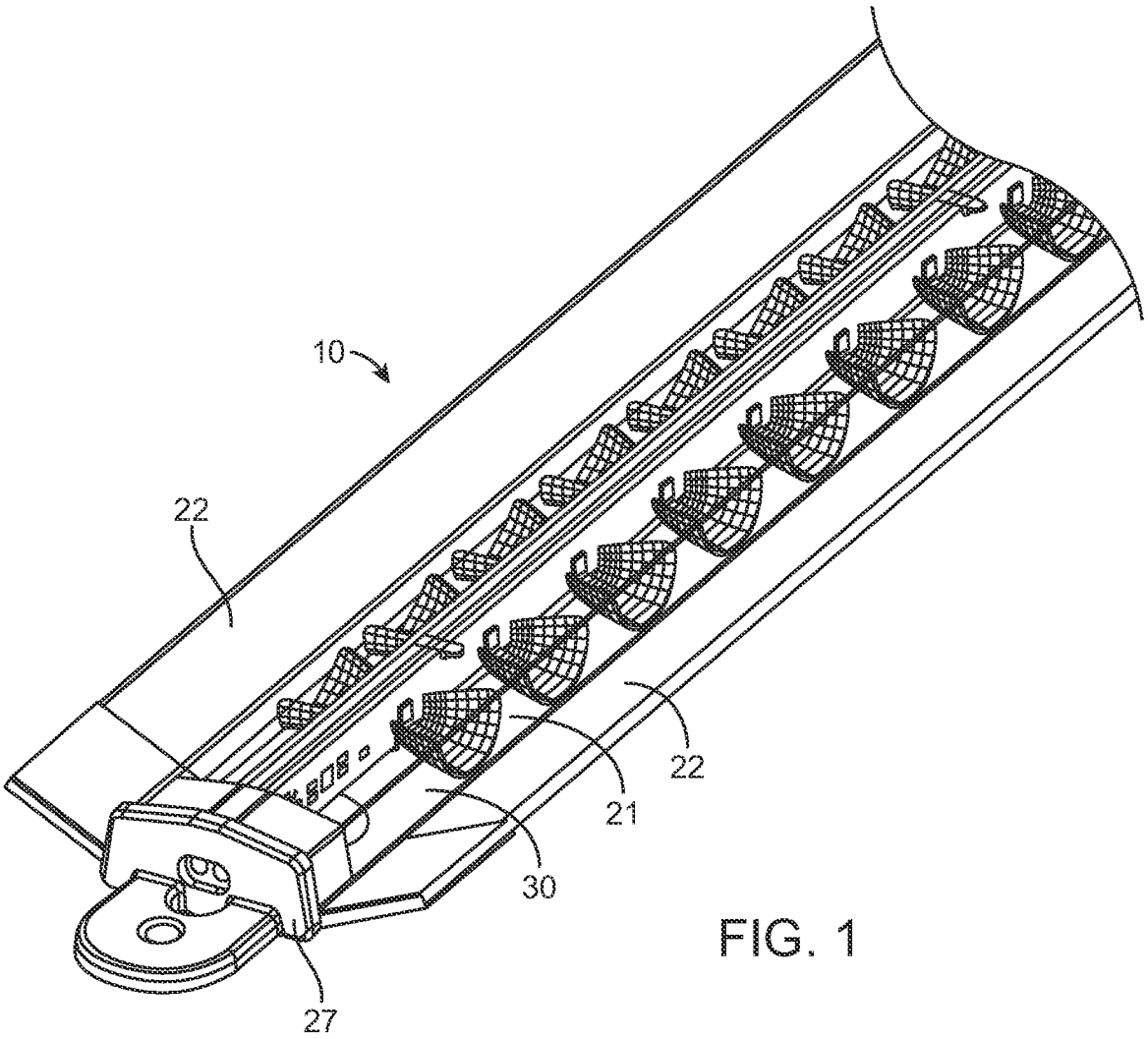
FIG. 1 is a perspective view of a first embodiment of the present LED lighting system, having a pair of angled wings for reflecting light and protecting a user's hands.
Figure 2:
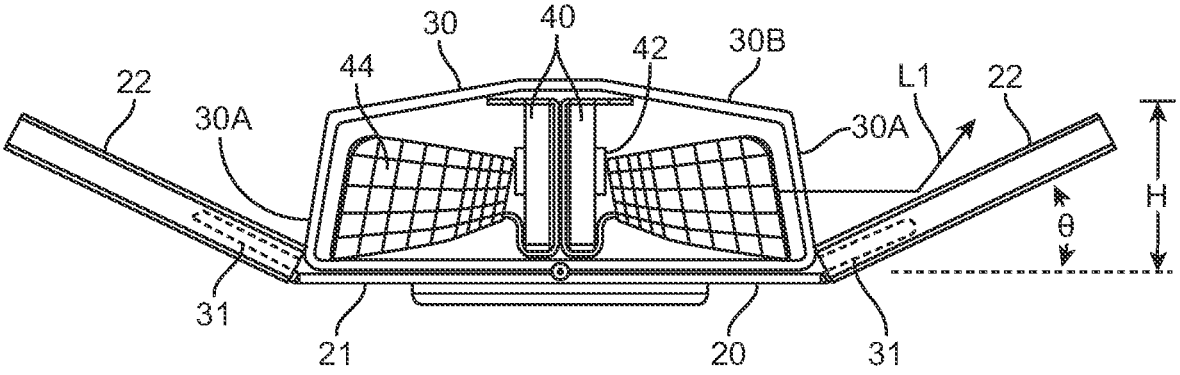
FIG. 2 is a side elevation view corresponding to FIG. 1, but with the end cap removed, showing the geometry of the angled wing wrapping around the opposite sides of the optical shield.
Figure 3:
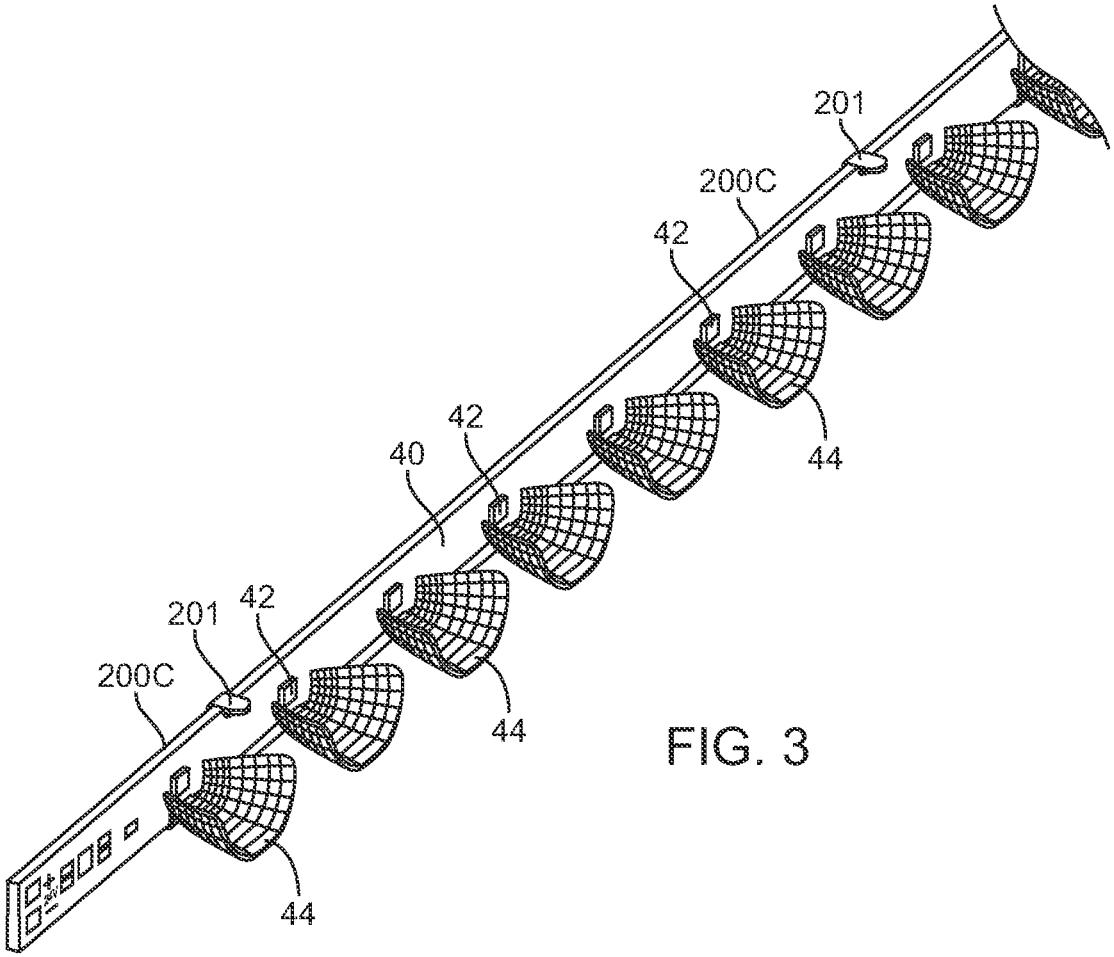
FIG. 3 is a perspective view of a lighting strip showing the LEDs and their associated coined reflective facet optics.
Figure 4:
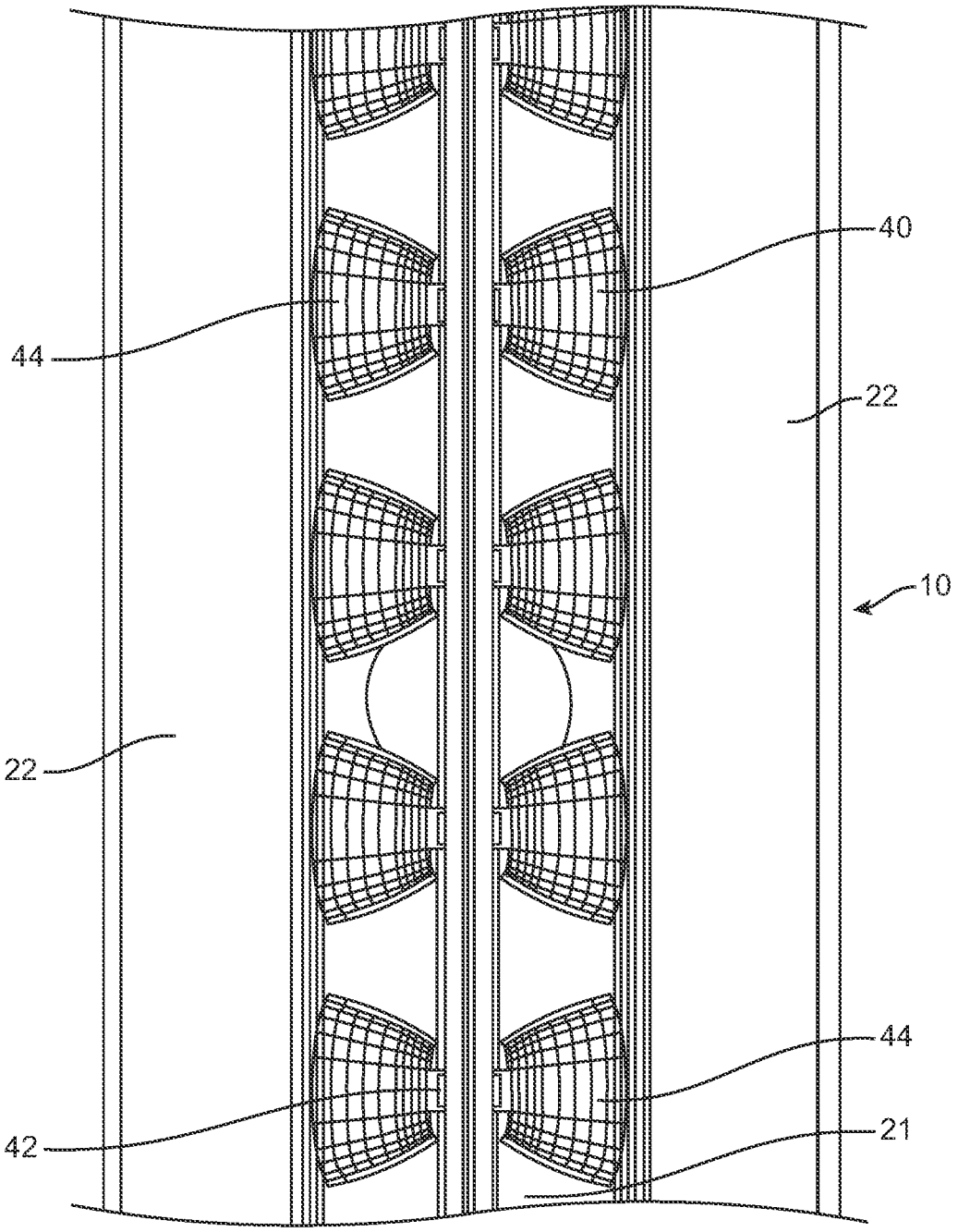
FIG. 4 is a top plan view of the embodiment of FIGS. 1 and 2.
Figure 5:
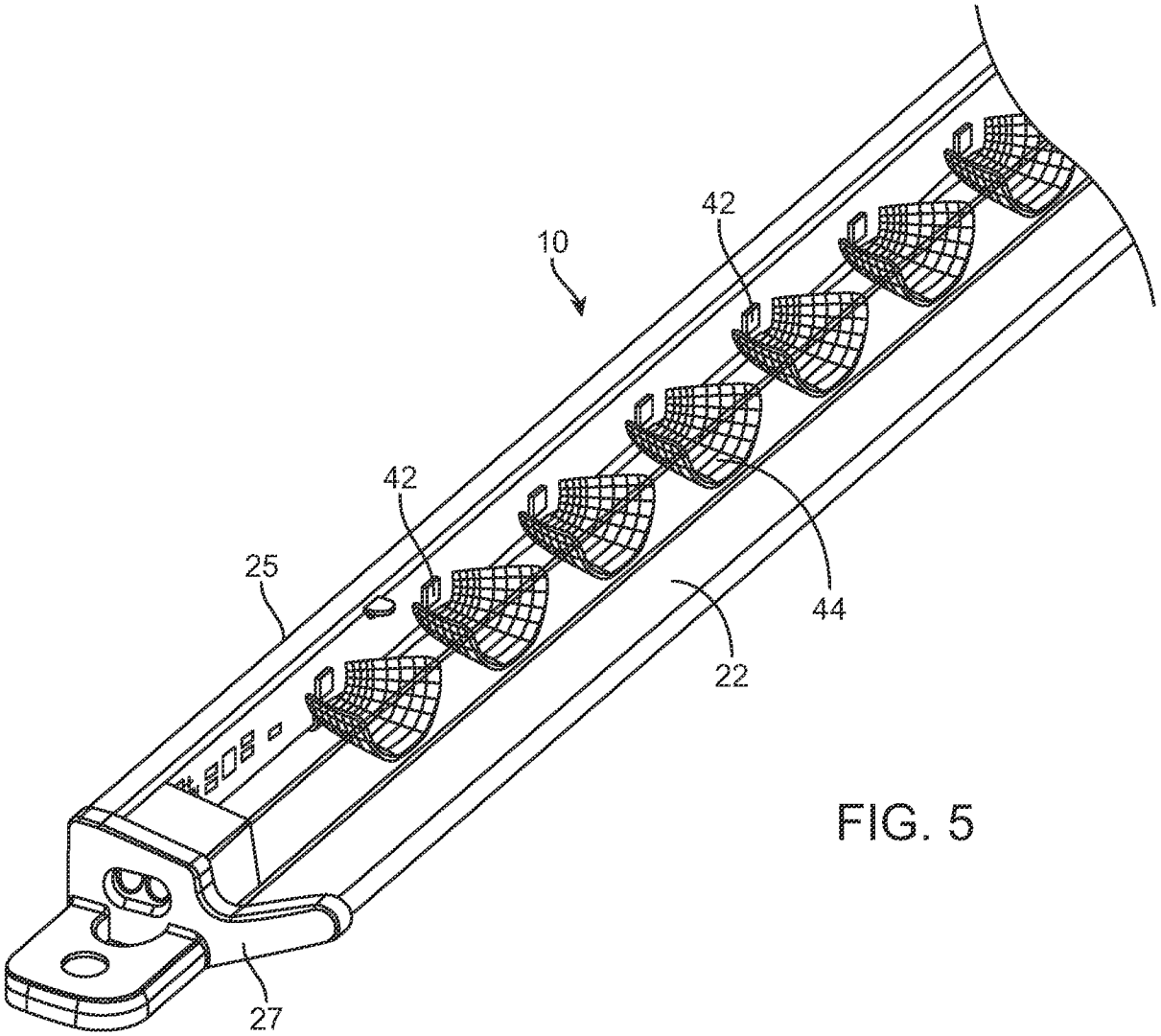
FIG. 5 is a perspective view of a second embodiment of the present LED lighting system, having a single angled wing for reflecting light and protecting a user's hands.
Figure 6:
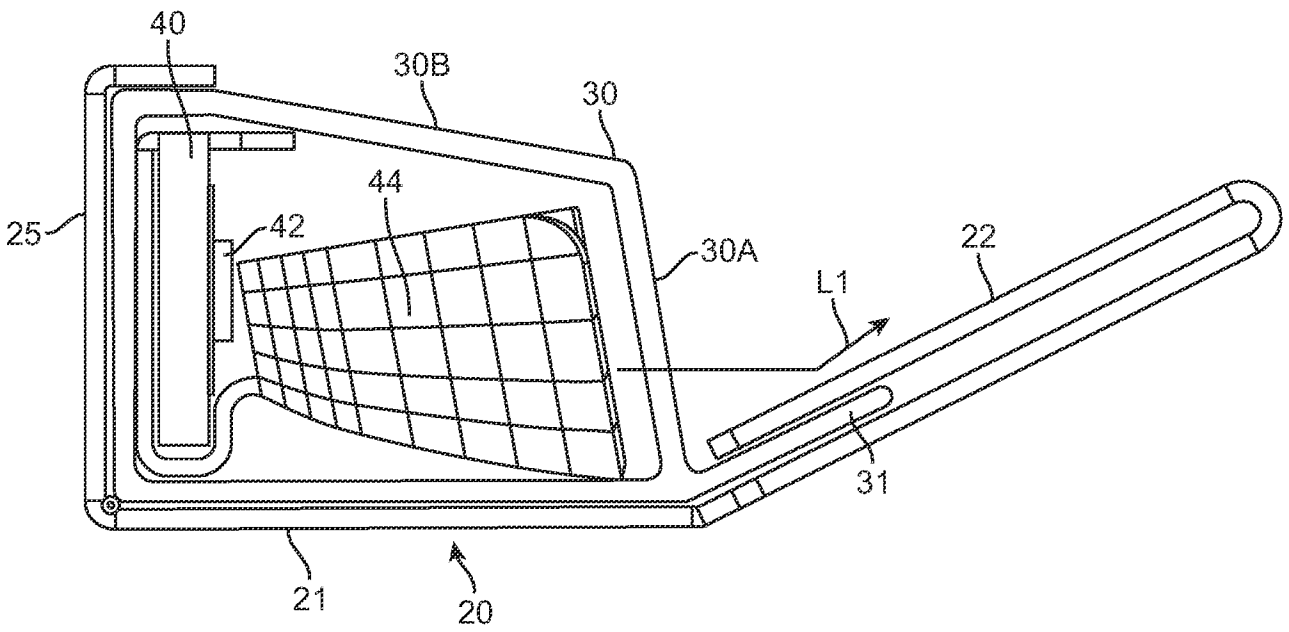
FIG. 6 is a side elevation view corresponding to FIG. 5, but with the end cap removed, showing the geometry of the angled wing wrapping around one side of the optical shield.

FIGS. 1, 2, and 4 represent a first ("two-wing") embodiment of the present illumination system in which light is emitted from both sides of the illumination system. FIGS. 5 and 6 represent a second ("one-wing") embodiment of the present illumination system in which light is emitted only from one side of the illumination system. FIG. 3 shows an LED lighting strip with associated coined reflective facet optics for insertion into either embodiment of the present lighting system.

Figure 7:
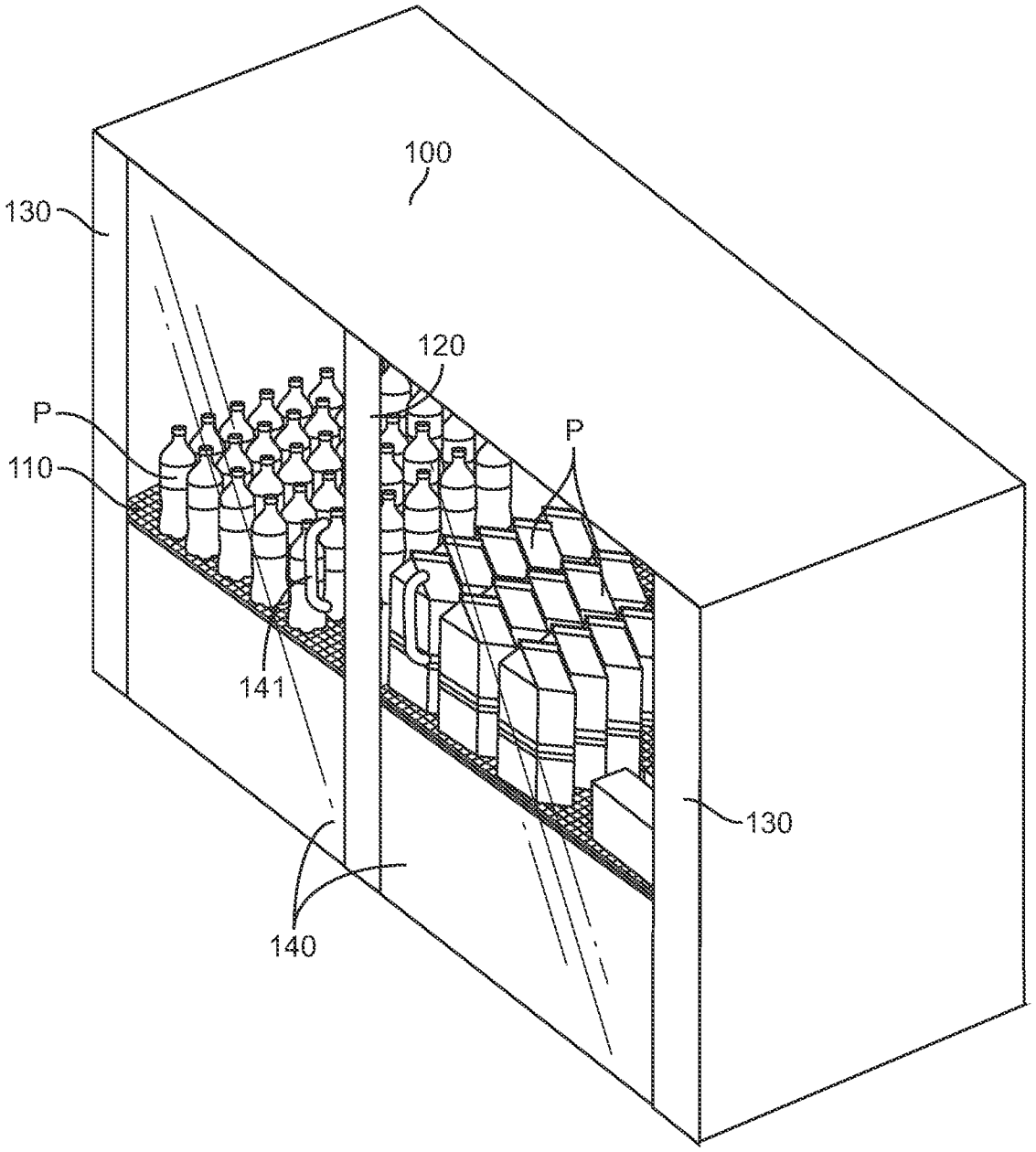
FIG. 7 is a front perspective view of a refrigerated cabinet with the present illumination system mounted therein.
Figure 8:
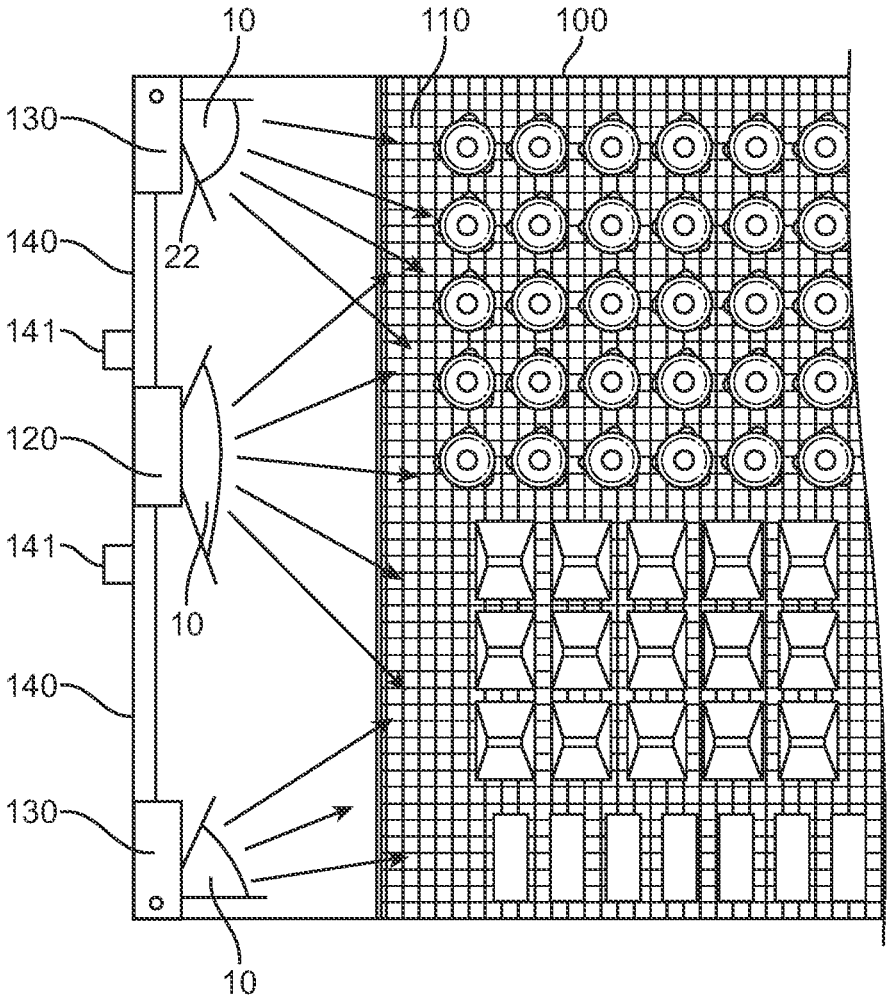
FIG. 8 is a top sectional view corresponding to FIG. 7.
Figure 9:
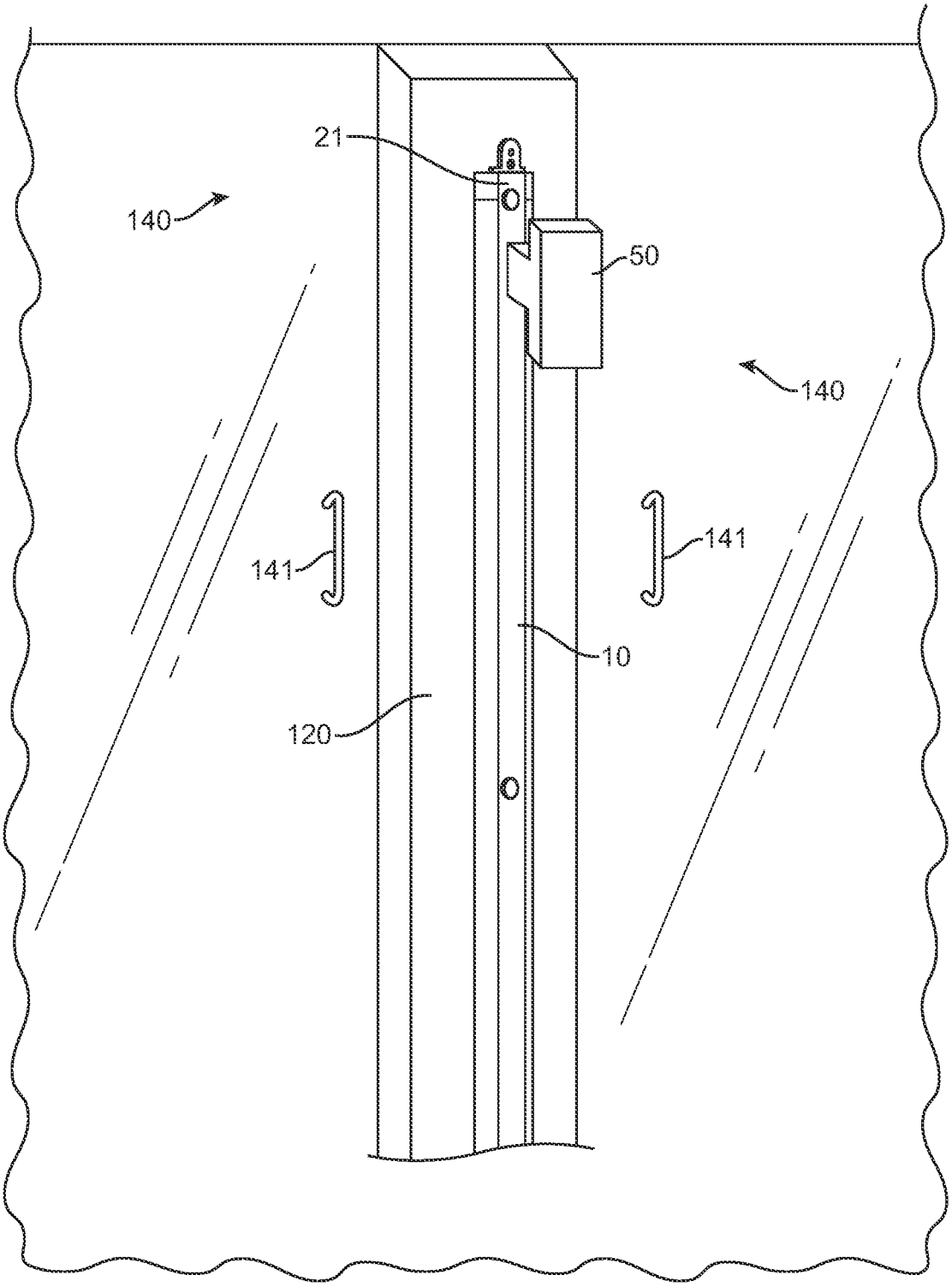
FIG. 9 is a perspective view of the present illumination system showing the positioning of an optional microwave proximity sensor.

FIGS. 7, 8 and 9 show the present system in use in a refrigerated cabinet.

Figure 10:
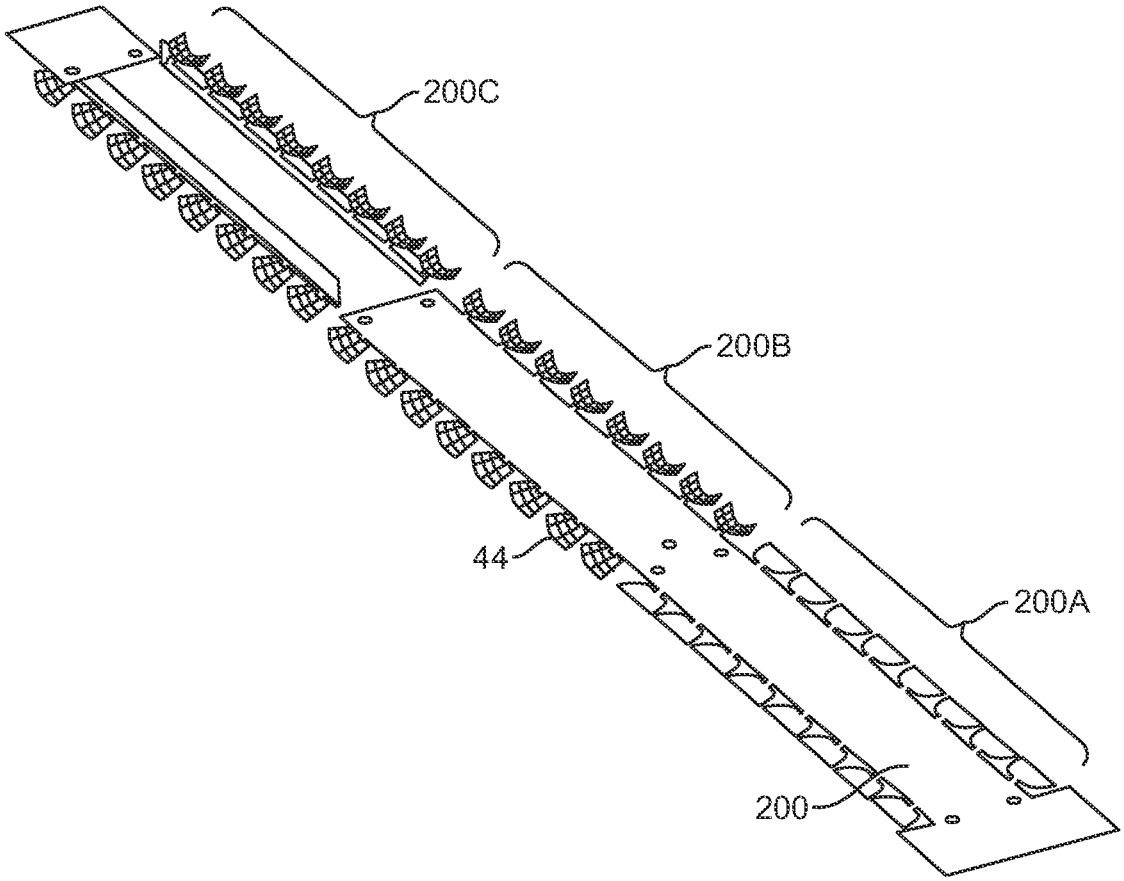
FIG. 10 is a perspective view illustrating successive steps in the stamping of the coined reflective facet optics.

Lastly, FIG. 10 shows steps in the manufacture of the LED lighting strips.

Referring first to the "two-wing" embodiment of FIGS. 1, 2, 4 and 5, a lighting system 10 is provided. Lighting system 10 comprises: a frame member 20 having a base 21 with a pair of angled wings 22 extending away from base 21; a light-transmitting optical shield 30 mounted onto frame member 20; and a pair of LED lighting strips 40 positioned between frame member 20 and optical shield 30.

As best seen in FIG. 2, the angled wings 22 extend outwardly beyond the side edges of the light-transmitting optical shield 30. As such, angled wings 22 prevent a user's fingers from coming into contact with optical shield 30. This provides a safety feature since optical shield 30 is preferably made of a transparent or translucent plastic which can become fragile (and prone to chipping or breaking) in the cold temperatures of the refrigerated cabinet. As such, the present angled wings protect the fingers of both a customer accessing products within the refrigerated cabinet, and a store person initially stocking the cabinet with product.

FIG. 2 also shows the ease of assembly of the present lighting system. Preferably, light-transmitting optical shield 30 is made of plastic and the angled wings 22 are made of metal. The metal may optionally be aluminum, but the present system is not so limited as other metals and materials may be used instead. As can be seen, the angled wings 22 and the frame member 20 itself can preferably be formed from the same block of material (for example as a metal extrusion, or simply by bending a planar sheet of material into this preferred shape). During assembly, the optical shield 30 is simply slid into frame member 20 with the angled wings 22 wrapping around the side edges 31 (shown in dotted lines) of optical shield 30.

As can also be seen in FIG. 2, the illumination is provided with a pair of lighting strips 40 positioned back-to-back and perpendicular to the base 21 of frame member 20. The advantage of this exemplary arrangement is that there is no intervening support wall required between the pair of LED lighting strips 40.

In preferred embodiments, angled wing 22 extends away from the base of the frame member at an angle θ of from 20 to 60, and more particularly about 30 degrees.

As best seen in FIG. 3, each LED lighting strip 40 has a plurality of spaced-apart LED lights 42 mounted therealong with a coined reflective facet optic 44 mounted around each LED light 42. The facet optics are formed by "coining" (i.e. cold forming) the shapes into a malleable metal surface. As such, these optical facets are formed with high precision and are shaped to direct light into a highly selectable illuminated area. This significantly reduces scattering and resultant glare. The present system of coining the facets into the metal is both highly accurate and inexpensive to produce. In various embodiments of the present system, the metal used for the coined reflective facet optics 44 may be aluminum, copper, or brass.

A second advantage of the coined reflective facet optics 44 are that (being metallic), have high heat conductivity that operates as a heat sink. This is important since the LEDs heat the circuit board that drives them, and this heat needs to be dissipated.

Further details of the applicant's novel coined optic facets and methods for their production are set forth in Applicant's U.S. Pat. No. 8,882,302, incorporated herein by reference in its entirety.

FIG. 4 provides a top view and FIG. 2 provides a sectional view showing light reflection according to the first (i.e.: "two-wing") embodiment of the invention. Specifically, as best seen in FIG. 2, angled wings 22 intercept and reflect light emitted from lights 42 on LED lighting strip 40. Specifically, each angled wing 22 reflects light L1 that has been emitted in a lateral (i.e.: out to the side) direction from lights 42 on LED lighting strip 40. As also seen, light-transmitting optical shield 30 has a pair of side portions 30A and a top portion 30B.

As can be seen in FIGS. 2 and 3, optical shield 30 covers open top ends 33 and open lateral ends 35 of each of the coined reflective facet optics 44. As can be seen, light-transmitting optical shield 30 extends continuously across the top 30B and both sides 30A of the lighting system between the pair of angled wings 22. As such, optical shield 30 extends continuously across 180 degrees of illumination.

As can also be seen in FIG. 2, each angled wing 22 preferably has a height H generally equal to the height H of a side portion 30A. As a result, the light emitted laterally (i.e.: in direction L1) through side portion 30A will be intercepted and reflected by angled wing 22. Front and back end caps (27 in FIG. 1) can be used to cover the ends of the optical shield and the at least one angled wing 22 (to prevent particles or contaminants from getting into the spaces between frame 20's wing 22 and the side edge of optical shield 30's side portion 30A).

FIGS. 5 and 6 illustrate a second (i.e.: "one-wing") embodiment of the present illumination system 10, having a side wall 25 extending perpendicular to base 21 of frame 20. As can be seen, side wall 25 extends from a first side of base 10 and the angled wing 22 extends from an opposite side of base 20. In this embodiment, a single LED lighting strip 30 is positioned mounted onto or adjacent to side wall 25. The light-transmitting optical shield 30 extends continuously across the top 30B and one side 30A of the lighting system. As such, the optical shield 30 extends continuously across 90 degrees of illumination. The "one-wing" embodiment of the present lighting system functions similarly to the "two-wing" embodiment of the present lighting system with angled wing 22 reflecting intercepting light emitted laterally outwardly from the side of the illumination system and reflecting the light in direction L1. As will be shown more fully below, the "one-wing" embodiment of FIGS. 5 and 6 can be mounted onto the left side of a cabinet to reflect light to the right, or it can be mounted on the right side of the cabinet to direct light to the left. As that would be required to achieve this would be to mount one lighting fixture upside-down from the other at the other side of the cabinet. Conceivably, a pair of "one-wing" fixtures can even be mounted back to back with their respective wings facing outwardly and be operated similar to the "two-wing" embodiment shown in FIGS. 1, 2 and 4.

FIGS. 7 and 8 illustrate a preferred use of the present illumination system 10 in a refrigerated cabinet 100 as follows. Cabinet 100 has interior shelves 110 onto which products P are positioned. Cabinet 100 preferably also has a front center beam 120 and left and right side beams 130. A pair of glass doors 140 are also provided, and the doors may be hinged onto opposite left and right side beams 130. Each glass door 140 may have a handle 141. Product P is stacked onto shelfs 110.

As best seen in FIG. 8, the centrally positioned "two-wing" illumination fixture (i.e.: the embodiment of the illumination system of FIGS. 1, 2 and 4) mounted onto beam 120 will illuminate the center of the cabinet with its wings 22 reflecting the light emitted out of the sides of the fixture to the left and right interior sides of the refrigerated cabinet. Similarly, each of the two side-mounted lighting fixtures (i.e.: the embodiment of the illumination system of FIGS. 5 and 6) mounted onto beams 130 provides illumination from the sides of the cabinet, with their respective wings 22 reflecting the light emitted out of the sides of the fixtures.

As can be seen in FIG. 8, the advantage of using the set of three above described illumination systems 10 in the cabinet is that the front facing sides of the products P receive illumination from two directions (i.e.: from one of the side mounted fixtures 10 and the center mounted fixture 10). There are several advantages to this lighting approach. First, having light coming from two directions onto the front of the products provides a bright and even illumination across the fronts of the products P. This makes the product labels clearly easy to read, even when the glass doors 140 are closed. Second, the effect of shadows is minimized since a user's hands will not likely block illumination coming from both directions. Third, as can be seen, angled wings 22 direct the light towards the front faces of the products which are recessed several inches from glass doors 140 to provide uniform lighting.

FIG. 9 illustrates an optional microwave proximity sensor 50 mounted onto the frame member 20 of the centrally mounted "two-wing" embodiment of the illumination fixture 10. As can be seen, microwave proximity sensor 50 is preferably mounted spaced apart (i.e.: several inches behind) the base 21 of frame member 20. In operation, microwave proximity sensor 50 is mounted spaced apart from beam 120 such that beam 120 does not interfere with its signal. As such, the microwave sensor 50's signal has a clear path of transmission through the glass doors 140 of the cabinet. In operation, microwave sensor 50 detects the presence of a customer in the area and the cabinet lighting can then be turned on (or simply increased in intensity) when a customer walks towards the refrigerated cabinet. Ideally, this may be done while the customer is still in a neighboring aisle of the store. As such, the customer would not even notice the activation or change in the lighting as they approach the refrigerated cabinet.

Lastly, FIG. 10 provides further explanation of the successive steps forming the coined reflective facet optics 44 and positioning them around the LED lighting strips 40, as follows. As seen in FIG. 11, a metal strip 200 can be first cut into the generally planar shape illustrated as 200A. Next, this strip can be advanced into a stamping machine (not shown) (where the metal strip is impacted from above and below) to form the shape of coin optic facets 44 illustrated as 200B. Finally, the metal strip can be further advanced into the stamping machine where the metal strip is then broken into two separate portions illustrated as 200C. Finally, as seen back in FIG. 3, the LED lighting strip 40 can then be received down into one of the two separate portions illustrated as 200C. Metal strip 200C can be attached around the top of LED lighting strip 40 with metal projections 201 being bent over the top of LED lighting strip 40, thereby forming the assembly that is inserted into the present illumination systems. As can be seen, the entire assembly of lighting strip 40 (with metal strip 200C wrapped therearound) is simple and easy to manufacture. As previously shown, the insertion of LED lighting strips 40 between frame 20 and optical shield 30 is also a simple and easy to perform operation. Finally, the assembly of optical shield 30 into frame 20 is also easy to perform (i.e.: simply by inserting the side edge of optical shield 30 into wing 22, and then sliding the optical shield 30 into position.

The present illumination system has other features and advantages as disclosed herein.

What is claimed is:

1. A lighting system, comprising:

a frame member having a base with at least one angled wing extending away from the base;

a light-transmitting optical shield mounted onto the frame member, the light-transmitting optical shield having an outwardly projecting side edge; and at least one LED lighting strip positioned between the frame member and the optical shield, wherein the LED lighting strip has a plurality of spaced-apart LED lights mounted therealong and a coined reflective facet optic mounted around each LED light, and wherein the at least one angled wing extends outwardly beyond the outwardly projecting side edge of the light-transmitting optical shield and reflects light emitted from the at least one LED lighting strip, and wherein the at least one angled wing wraps around and is in supporting contact with the outwardly projecting side edge of the light-transmitting optical shield.

2. The lighting system of claim 1, wherein the angled wing reflects light emitted in a lateral direction from the at least one LED lighting strip.

3. The lighting system of claim 2, wherein the light-transmitting optical shield has at least one side portion and a top portion, and wherein the at least one angled wing reflects light emitted in the lateral direction through the at least one side portion.

4. The lighting system of claim 3, wherein the at least one angled wing has a height generally equal to the height of the side portion of the light-transmitting optical shield.

5. The lighting system of claim 1, wherein the at least one angled wing extends away from the base of the frame member at an angle of between 20 and 60 degrees.

6. The lighting system of claim 1, wherein the at least one angled wing extends away from the base of the frame member at an angle of about 30 degrees.

7. The lighting system of claim 1, wherein the light-transmitting optical shield is made of plastic and the at least one angled wing is made of metal.

8. The lighting system of claim 1, wherein the at least one angled wing and the frame member are formed from the same block of material.

9. The lighting system of claim 1, wherein the outwardly projecting side edge of the optical shield is inserted into the angled wing.

10. The lighting system of claim 1, wherein the angled wing wraps around the outwardly projecting side edge of the optical shield.

11. The lighting system of claim 1, wherein the optical shield extends over and covers open top ends and open lateral side ends of each of the coined reflective facet optics.

12. The lighting system of claim 1, further comprising:

a microwave proximity sensor mounted onto the frame member.

13. The lighting system of claim 1, further comprising:

front and back end caps covering ends of the optical shield and the at least one angled wing.

14. The lighting system of claim 1, wherein:

the at least one angled wing is a pair of angled wings extending from opposite sides of the base of the frame member, and the at least one LED lighting strip is a pair of lighting strips positioned back-to-back perpendicular to the base of the frame member.

15. The lighting system of claim 14, wherein there is no intervening support wall between the pair of LED strips.

16. The lighting system of claim 14, wherein the light-transmitting optical shield extends continuously across the top and both sides of the lighting system between the pair of angled wings.

17. The lighting system of claim 1, further comprising:

a side wall extending perpendicular to the base of the frame, wherein the side wall extends from a first side of the base and the at least one angled wing comprises a single angled wing that extends from an opposite side of the base.

18. The lighting system of claim 17, wherein the at least one LED lighting strip is a single LED lighting strip positioned adjacent to the side wall.

19. The lighting system of claim 17, wherein the light-transmitting optical shield extends continuously across the top and one side of the lighting system.

20. The lighting system of claim 1, wherein the lighting system is positioned within an enclosure for illuminating the enclosure.

* * * * *